US011661225B2

(12) United States Patent
Beesley et al.

(10) Patent No.: US 11,661,225 B2
(45) Date of Patent: May 30, 2023

(54) CENTER DIVIDER FOR SHRINK OVEN

(71) Applicant: ILLINOIS TOOL WORKS INC., Glenview, IL (US)

(72) Inventors: Robert C. Beesley, Greenville, SC (US); Mark Davidson, Greer, SC (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 480 days.

(21) Appl. No.: 16/597,579

(22) Filed: Oct. 9, 2019

(65) Prior Publication Data

US 2020/0115085 A1 Apr. 16, 2020

Related U.S. Application Data

(60) Provisional application No. 62/743,805, filed on Oct. 10, 2018.

(51) Int. Cl.
*B65B 53/06* (2006.01)

(52) U.S. Cl.
CPC ..... *B65B 53/063* (2013.01)

(58) Field of Classification Search
CPC ..... B65B 53/063; F26B 3/02; F26B 3/04
USPC ..... 53/442, 557; 165/62, 219
See application file for complete search history.

(56) References Cited

U.S. PATENT DOCUMENTS 3,717,939 A 2/1973 Mitchell
4,198,560 A * 4/1980 Dietrich ..... B65B 53/02 432/239
2002/0073661 A1* 6/2002 Nolan ..... B29C 66/73715 53/557
2004/0231301 A1* 11/2004 VanderTuin ..... B65B 53/063 432/242
2010/0058715 A1* 3/2010 Schilling ..... B65B 53/063 53/64
2010/0077702 A1* 4/2010 Lelie ..... B65B 53/063 53/442
2014/0331617 A1* 11/2014 Napravnik ..... G01N 21/8806 53/493

(Continued)

FOREIGN PATENT DOCUMENTS

DE 10 2012 103 402 A1 10/2013
EP 2 319 769 A1 5/2011
EP 2 347 960 A1 7/2011

(Continued)

OTHER PUBLICATIONS

U.S. Patent Office, English language version of the International Search Report, Form PCT/ISA/210 for International Application PCT/US2019/055610, dated Jan. 24, 2020 (6 pages).

(Continued)

*Primary Examiner* — Anna K Kinsaul
*Assistant Examiner* — Luis G Del Valle
(74) *Attorney, Agent, or Firm* — Pauley Erickson & Swanson

(57) ABSTRACT

Heat shrink wrap product packaging oven or tunnel apparatus and processing methods are provided which incorporate or utilize a central divider mechanism. The central divider moves over a conveyor between a vertical, dual track position, and a retracted, single track position. The divider can additionally include a curved deflector that focuses and/or smooths air flow from the divider laterally across the dual track conveyance path.

9 Claims, 10 Drawing Sheets

(56) References Cited

U.S. PATENT DOCUMENTS

2018/0209740 A1 7/2018 Beesley et al.

FOREIGN PATENT DOCUMENTS

| | | | | |
|---|---|---|---|---|
| EP | 2347960 A1 * | 7/2011 | ..... | B65B 53/063 |
| EP | 2 554 483 A1 | 2/2013 | | |
| EP | 3 351 481 A1 | 7/2018 | | |
| EP | 3446991 A1 * | 2/2019 | ..... | B65B 21/245 |

OTHER PUBLICATIONS

U.S. Patent Office, English language version of the Written Opinion of the ISA, Form PCT/ISA/237 for International Application PCT/US2019/055610, dated Jan. 24, 2020 (8 pages).

* cited by examiner

CENTER DIVIDER FOR SHRINK OVEN

CROSS REFERENCE TO RELATED APPLICATION

This application claims the benefit of U.S. Provisional Patent Application, Ser. No. 62/743,805, filed on 10 Oct. 2018. This Provisional Application is hereby incorporated by reference herein in its entirety and is made a part hereof, including but not limited to those portions which specifically appear hereinafter.

BACKGROUND OF THE INVENTION

Field of the Invention

This invention relates generally to product packaging and, more particularly, to product packaging using an oven to shrink wrap a shrink wrap material about products.

Description of Prior Art

It is known to provide a wrap of material about products such as to facilitate or otherwise improve product handling, transport and the like. To that end, it has become common to wrap product with a tube of heat shrink wrap film and then apply heat to effectively shrink the wrap about the product such as to form a packaged product. A common example of product so wrapped includes a plurality of articles such as beverage bottles or like containers.

As will be appreciated, the resulting package product can result in a grouping of a plurality of articles that can be more easily or conveniently handled or transported, such as may include facilitating such handling or transporting via mechanical devices, for example. Further, the packaging can desirably prevent or avoid undesirable product contact such as by debris, dirt, dust and the like, for example.

The heating of a product wrapped with a tube of heat shrink wrap film is often conducted in an apparatus sometimes referred to a shrink wrap oven or tunnel. Typically, a load of product wrapped with a tube of heat shrink wrap film is introduced into the shrink wrap oven or tunnel via a conveyor passing through the shrink wrap oven or tunnel. As the load is passed through the shrink wrap oven or tunnel, heat such as supplied by a heater device is applied to the load via a blower with the heat acting to shrink the film through convection.

In current practice, such shrink wrap ovens or tunnels are typically placed just after another machine that groups articles together and wraps them in the heat shrinkable film. The film is wrapped around the product and either welded with a seam or the film overlaps underneath and must be welded in the shrink wrap oven or tunnel. At this point the film loosely covers the group of articles and must be shrunk with heat.

There are current ovens that include an air box with a series of holes to discharge the air. The air box can include a component hung from the top, and can be mounted so it can be moved from the middle of the oven to the side. This requires the upper component to be used on the side for single track packages and can compromise the quality of the package. Furthermore, the box typically is feed with flexible hoses for the hot air which require maintenance. In addition, the holes on either side of the upper component often create a turbulent airflow that will often cause the film to flutter and contact the package prematurely.

In view of the above, there is a need for an improved heat shrink wrap product packaging apparatus and methods.

SUMMARY OF THE INVENTION

A general object of the invention is to provide an improved heat shrink wrap product packaging apparatus and methods.

Embodiments of this invention include a swing divider for providing hot air, such as mounted on large solid ducts over the top of an oven conveyor. The solid ducts eliminate the need for maintenance, and can include a large center duct box to control the air to the swing divider. The divider can be hinged to the duct box, so it can swing to a vertical position between packages in a dual track on the conveyor. The divider can also swing to a retracted, horizontal position above the packages to run a single product track. The divider typically is only used for dual track, so the oven air flow does not have to be compromised for single track.

Additionally or alternatively, embodiments of this invention include a center divider with a generally continuous lower opening and a deflector below the divider. The deflector converts the jets of air from the lower end of the deflector into one or more smooth air flows. This smooth air flow prevents the film from fluttering and can cause it to inflate like a bubble, making a tighter and a better-looking package. This also can eliminate necessary adjustments.

In accordance with one aspect of the invention, an improved apparatus for heat shrink wrap product packaging is provided. In some embodiments, such an apparatus includes first and second opposed and spaced apart side wall assemblies. The first and second side wall assemblies define a longitudinally extending product conveyance path therebetween. The apparatus includes a conveyor to move product along the conveyance path. Each of the side wall assemblies can include an inner wall spaced apart from an outer wall and define or include an air flow duct therebetween. Each of the inner walls desirably includes an array of spaced apart air discharge openings directed towards and associated with the product conveyance path. The apparatus further includes at least one heater/blower assembly disposed in the apparatus. The at least one heater/blower assembly is in heated air flow communication with the air flow duct of each of the side wall assemblies. A cover assembly is included and is disposed over and at least in part enclosing at least a section of the product conveyance path and at least a portion of the array of spaced apart air discharge openings directed towards and associated with the product conveyance path from the first and the second side wall assemblies.

Embodiments of the apparatus include a center divider extending above the conveyance path between the first and second opposed and spaced apart side wall assemblies. As used herein, "center" refers to a position between the side walls, and is not limited to an exact center equidistant between the side walls. The center divider of this invention can be a swing divider that moves between a retracted position and a vertical position dividing the conveyance path from a single track to a dual track conveyance path. The center divider can be connected to an upper duct system by a rotation connection, such as a hinge.

In embodiments of this invention, the center divider, such as a swing or other divider, includes an internal air passageway and a deflector mechanism in combination with the center divider to direct the air flow laterally across the conveyance path. Desirably, the air flow from the deflector mechanism includes two oppositely directed jets of air laterally across the conveyance path, such as each toward one of the side walls. The deflection mechanism can include a curved deflector at a lower air outlet end of the center divider, such as curved on each side toward a corresponding one of the side walls. An internal air passageway of the center divider can reduce in diameter from an inlet to the outlet end to funnel air to a curved deflector that divides the air from the outlet end into two lateral jets of air.

In accordance with another aspect of the invention there is provided an improved method for shrink wrapping a product to form a packaged product. In one embodiment, such a method involves conveying product wrapped with a tube of heat shrink wrap film on a conveyor where the conveyor forms a conveyance path disposed between first and second opposed and spaced apart side walls. Streams of heated air are projected from the first and second opposed and spaced apart side walls and toward the wrapped product on the conveyance path. The projection of the streams of heated air from the first and second opposed and spaced apart side wall assemblies and toward the wrapped product on the conveyance path are advantageously controlled by to shrink the tube of film onto the product to form the packaged product.

In some embodiments of this invention, the method further includes: conveying a product wrapped with a tube of heat shrink wrap film along the conveyance path with a center divider in the retracted position; lowering the center divider into the vertical position to form dual track paths on the conveyance path; conveying a pair of further products each wrapped with a tube of heat shrink wrap film along the conveyance path, with the center divider disposed between the pair of further products; and projecting streams of heated air from the center divider toward each of the pair of further products. In some embodiments of this invention, the method alternatively or additionally further includes: conveying a pair of products each wrapped with a tube of heat shrink wrap film along the conveyance path, with the center divider disposed between the pair of products; projecting streams of heated air from an end of the center divider; and deflecting the heated air from the end laterally toward a side of each of the pair of further products facing the center divider.

Other objects and advantages will be apparent to those skilled in the art from the following detailed description taken in conjunction with the appended claims and drawings.

Figure 1:
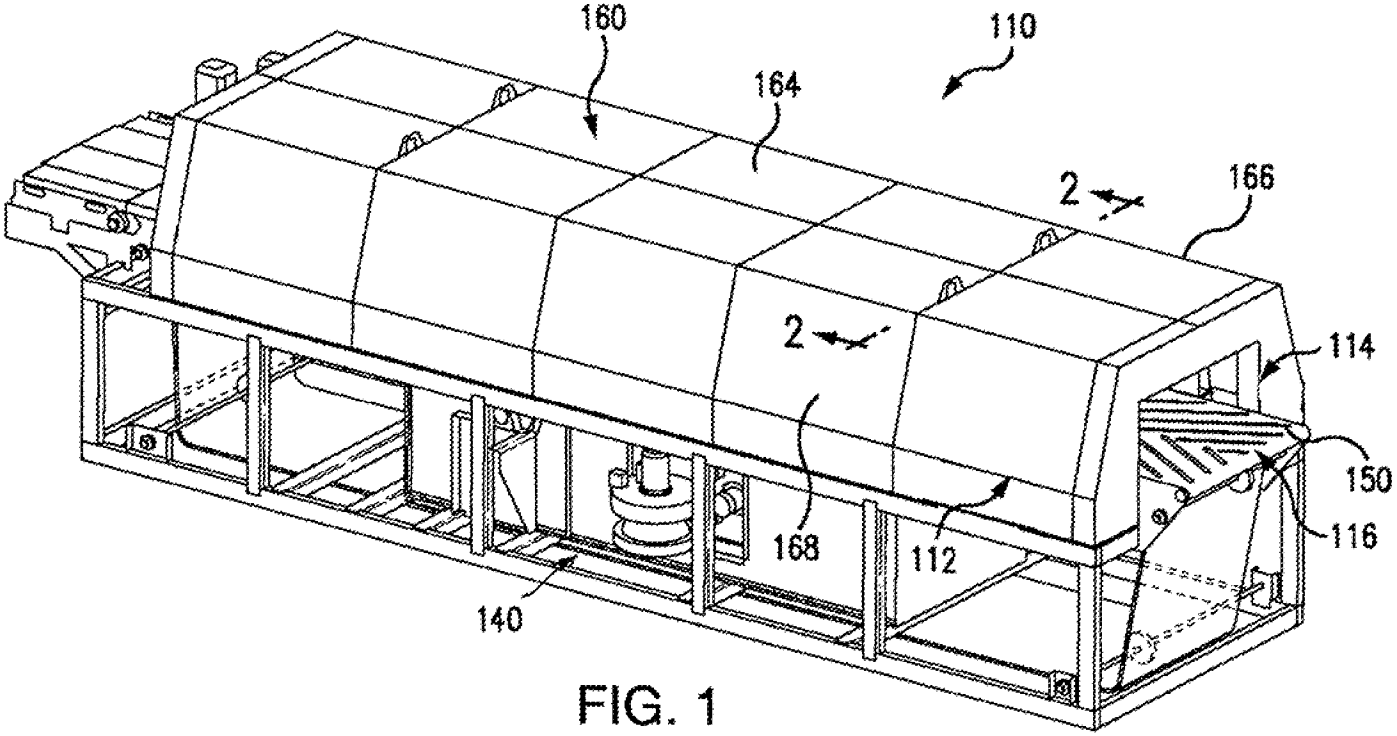
FIG. 1 is a perspective view of an apparatus for heat shrink wrap product packaging according to one embodiment of this invention.

It is to be understood that in the drawings, like reference characters designate like or corresponding parts throughout the several views. It is to be further understood that certain standard elements not necessary for an understanding of the invention may have been omitted or removed from the drawings and description for purposes of facilitating and enhancing illustration and/or comprehension.

DESCRIPTION OF PREFERRED EMBODIMENTS

The subject development provides improved heat shrink wrap product packaging apparatus and methods.

FIG. 1 illustrates an apparatus, generally designated by the reference numeral 110, for heat shrink wrap product packaging according to one aspect of the subject development. The apparatus 110 is of a type such as can be referred to as a shrink or shrink wrap oven or tunnel and through which product wrapped in plastic film is conveyed to shrink, e.g., heat shrink, the film to form a packaged product.

In an effort to enhance understanding and appreciation of the subject invention development, the drawings have been simplified and the description has been focused on distinguishing features. Thus in the drawings and associated description, normal or customary items for shrink or shrink wrap ovens or tunnels may not herein be specifically identified and discussed.

While beverage bottles or like containers are an example of a common product that can be so processed to form a packaged product, those skilled in the art and guided by the teachings herein provided will understand and appreciate that the broader practice of the subject development is not necessarily so limited and a wide range of products such as known can, if desired, be suitably processed using the apparatus and methods herein provided.

The apparatus 110 includes first and second opposed and spaced apart side wall assemblies 112 and 114. The first and second side wall assemblies 112 and 114 defining a longitudinally extending product conveyance path 116 therebetween. The apparatus 110 includes a conveyor 150 to move product along the conveyance path 116 longitudinally extending between the side wall assemblies 112 and 114, respectively. As explained further below, the conveyance path of embodiments of this invention can be a single track, a double track, and/or alternate from one to the other, as may be desired for a particular application.

As will be appreciated, an apparatus such as herein provided can desirably be sized and adjusted to appropriately accommodate variously sized product packages. For example, an apparatus according to one preferred embodiment, permits or accommodates processing of a package measuring 17 inches high and 38 inches wide. Further, an apparatus according to one preferred embodiment, has a capacity or permits processing of, without limitation, 100 cases of product packages per minute.

Each of the side wall assemblies 112 and 114 include an inner wall 120 spaced apart from an outer wall 122 and defining or including an air flow duct 124 therebetween to form what is sometimes referred to as an air box. Each of the inner walls 120 can include an array of spaced apart air discharge openings 126 that are directed towards and associated with the product conveyance path 116. The first and second side wall assemblies 112 and 114 each include an optional airfoil element 130, such as discussed in U.S. patent application Ser. No. 15/876,826, for air flow control from the air discharge openings 126 in the respective inner wall.

The apparatus 110 further includes a heater/blower assembly, generally designated by the reference numeral 140. The heater/blower assembly 140 can suitably include a blower and a heating element or device, such as known in art, for example. Heating elements or devices for use according to certain embodiments can suitably be or take the form of being gas-powered or electric-powered, as may be desired for a specific or particular application. The apparatus 110 further includes suitable conduits or connections such as may form a plenum including air flow ducts such that the heater/blower assembly 140 is in heated air flow communication with the air flow duct of each of the side wall assemblies 112 and 114, respectively.

The apparatus 110 also includes a cover assembly 160. As shown, the cover assembly 160 is desirably disposed over and at least in part encloses at least a section of the product conveyance path 116 and at least a portion of the array of spaced apart air discharge openings 126 directed towards and associated with the product conveyance path 116 from the first and the second side wall assemblies 112 and 114, respectively. The cover assembly 160 includes a top portion 164 and opposed lateral side wall portions 166 and 168 such as to enclose the corresponding section of the product conveyance path 116. In accordance with on preferred embodiment, the cover assembly desirably is of a monocoque construction. As will be appreciated by those skilled in the art and guided by the teachings herein provided, the incorporation and use of a cover assembly of monocoque construction can one or more of: eliminate welding, reduce weight and/or reduce costs.

Figure 2:
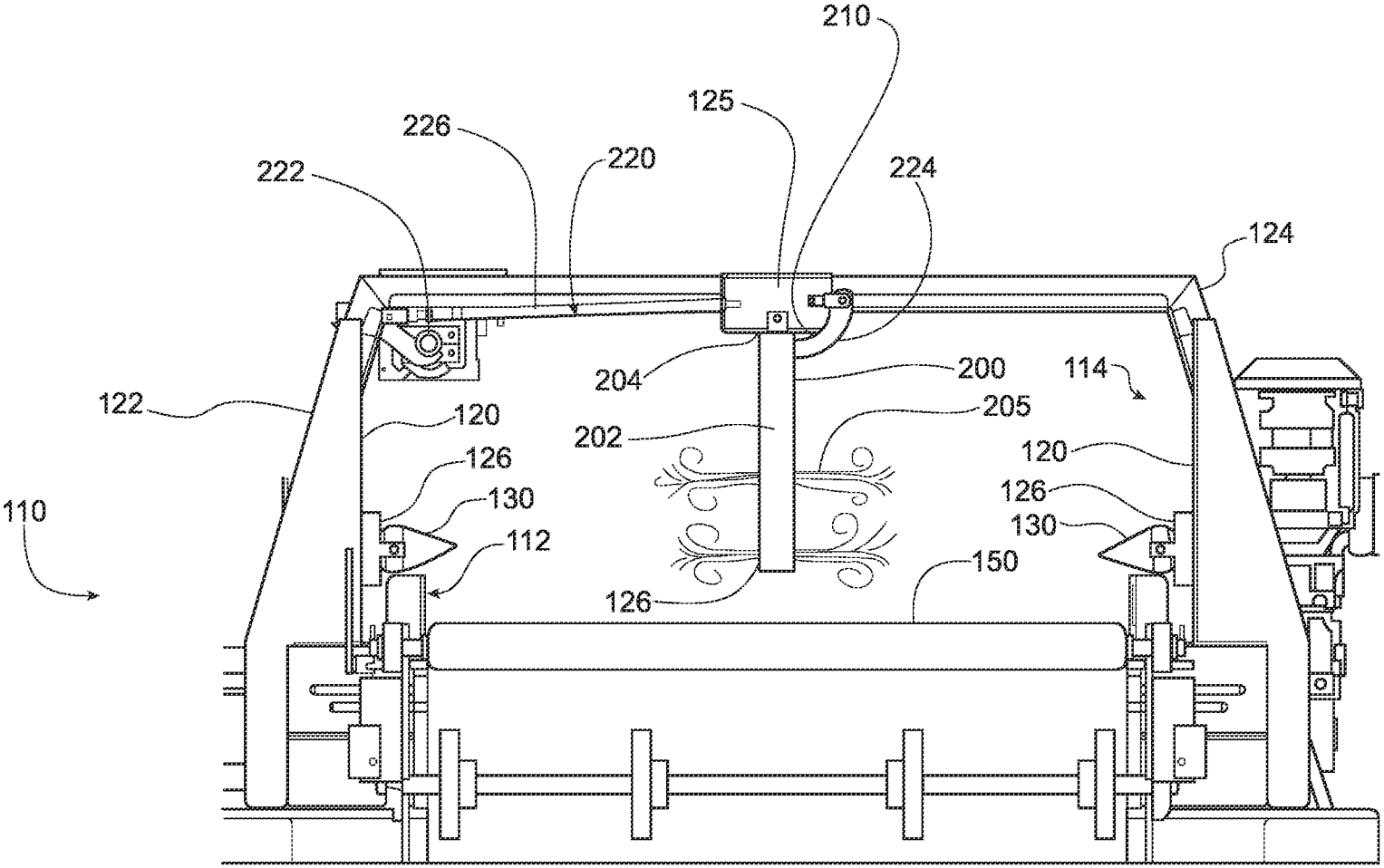
FIG. 2 is a simplified sectional view along the line 2-2 shown in FIG. 1.
Figure 3:
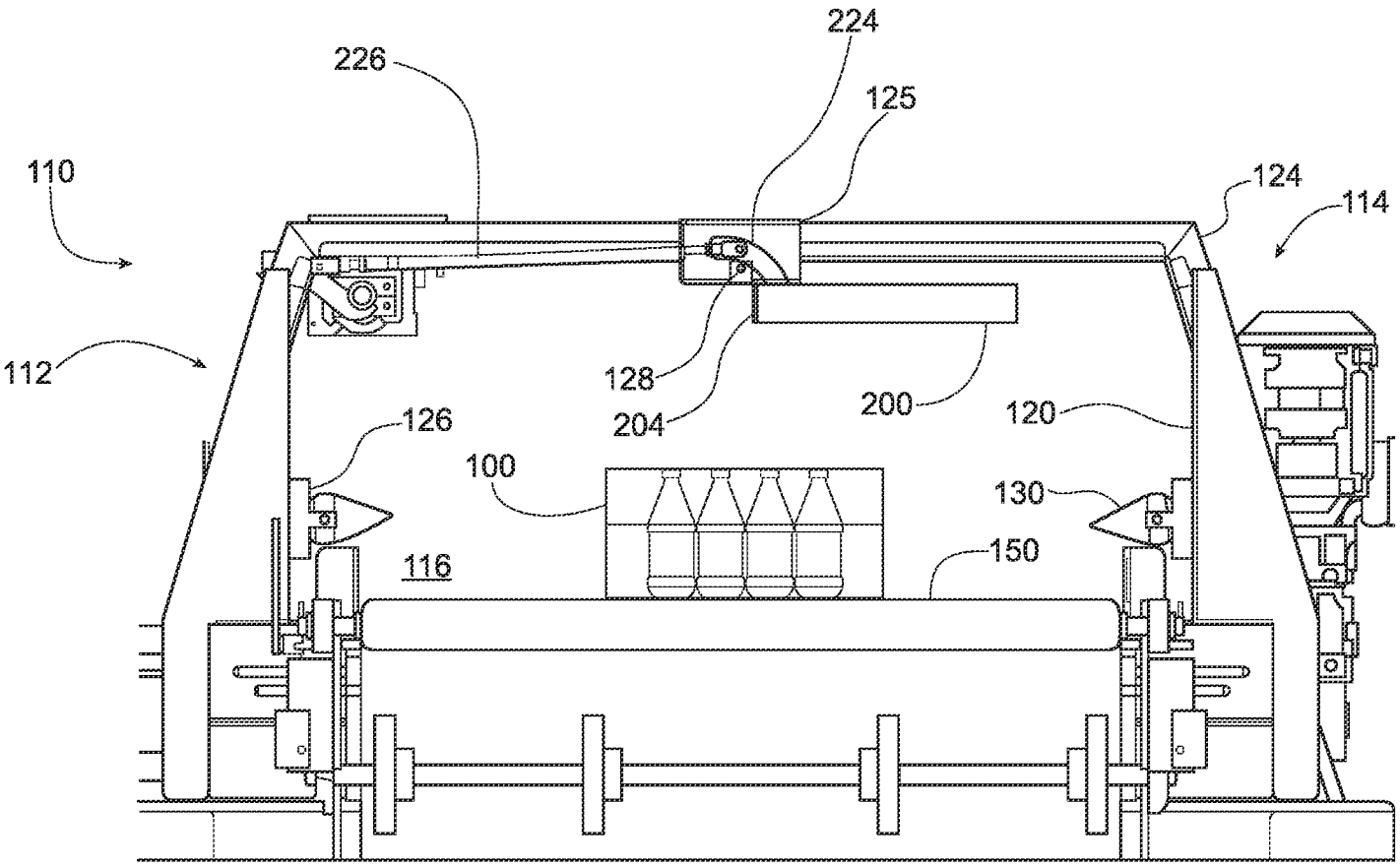
FIG. 3 is a simplified sectional perspective view along the line 2-2 shown in FIG. 1, in a retracted position.
Figure 4:
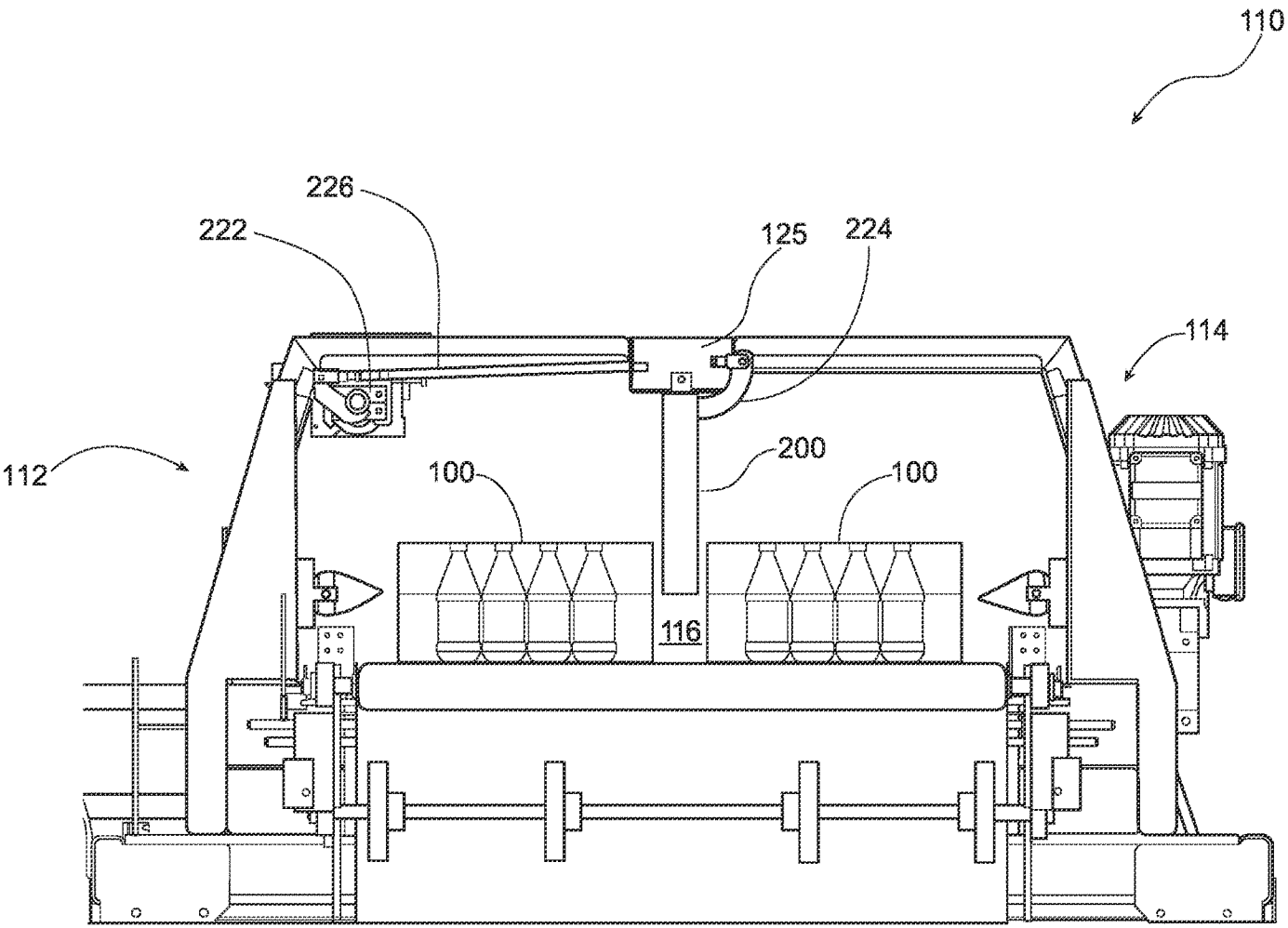
FIG. 4 is a simplified sectional perspective view along the line 2-2 shown in FIG. 1, in a non-retracted position.

The apparatus of this invention incorporates a divider element to divide the conveyor into a double track conveyor, and/or to provide a better hot air flow over the conveyed products. The divider element typically extends from a top inner surface of the oven and above the conveyor. FIGS. 2-4 illustrate a divider element, namely center divider 200, extending above the conveyance path 116 and between the first and second opposed and spaced apart side wall assemblies 112 and 114.

The center divider 200 is connected to the heater/blower assembly 140 to deliver hot air to the conveyance path 116. The center divider 200 can receive the hot air via any suitable mechanism, such as flexible hoses, but desirably is connected to solid, rigid air flow duct 124. The center divider 200 includes an internal air passageway 202 in combination with the duct 124, and that delivers hot air to lateral openings to provide hot air streams 205 across the conveyance path 116. Any suitable opening array can be used on the side walls of the central divider, depending on need.

As shown in FIG. 2, the center divider 200 is a swing divider that moves between a vertical, dual track position (disposed between two package tracks) of FIGS. 2 and 4 and the retracted, single track position of FIG. 3. The swing divider 200 is connected to the oven by a rotation connection, such as a hinge 210 connected to the duct 124. In FIGS. 2-4, the hinge 210 connects an edge of a first end 204 of the swing divider 200 to a central duct structure 125 extending longitudinally above and along the conveyance path 116. The central duct structure 125 includes an air outlet 128 that corresponds with an air inlet of the divider first end 204. The air outlet 128 can be a simple opening that releases air in the retraced position over a single track of FIG. 3, includes a cover or diffuser element that moves into place upon the retraction of the center divider 200, and/or otherwise includes a valve structure to control the air through the outlet 128.

Any suitable mechanism can be used to swing the divider 200 to the retracted position. In the embodiment of FIGS. 2-4, a mechanical linkage 220 and an electric motor 222 move the swing divider 200 between the two positions. A curved arm 224 extends from the divider 200 about the hinge 210 to connect to a second arm 226. The second arm 226 extends to the electric motor 222, and rotational movement of the motor 222 moves the second arm 226, which moves the end of the curved arm 224 causing the divider 200 to translate the linear motion of the second arm 226 to rotational movement about the hinge 210.

The central divider 200 can thus be moved from a retracted position shown in FIG. 3 to the vertical position of FIGS. 2 and 4. As shown in FIG. 3, the retracted position provides a single rack conveyance path 116 for a single track of products 100. FIG. 4 shows the dual track conveyance path, with the divider 200 extending between a pair of products 100, and laterally providing air streams toward each of the two products 100.

FIGS. 5-10 illustrate a center divider 200 according to another embodiment of this invention, including a deflector mechanism 230. As shown, the center divider 200 is also a swing divider, operating in a similar manner to that of FIGS. 2-4, but the deflector mechanism can be used in other non-swinging, or stationary, center dividers as well.

Figure 5:
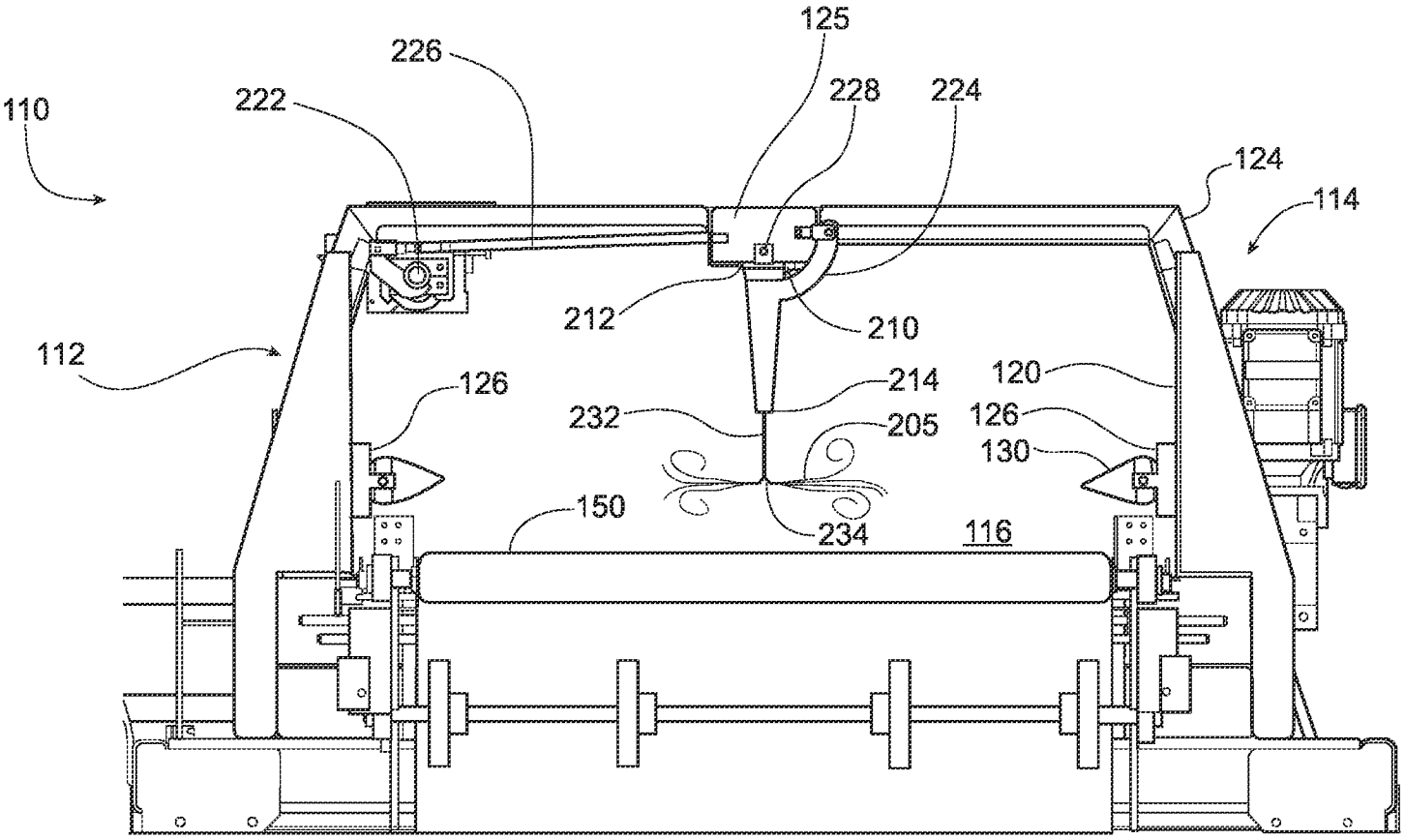
FIG. 5 is a simplified sectional view of an apparatus for heat shrink wrap product packaging in according to one embodiment of this invention.
Figure 6:
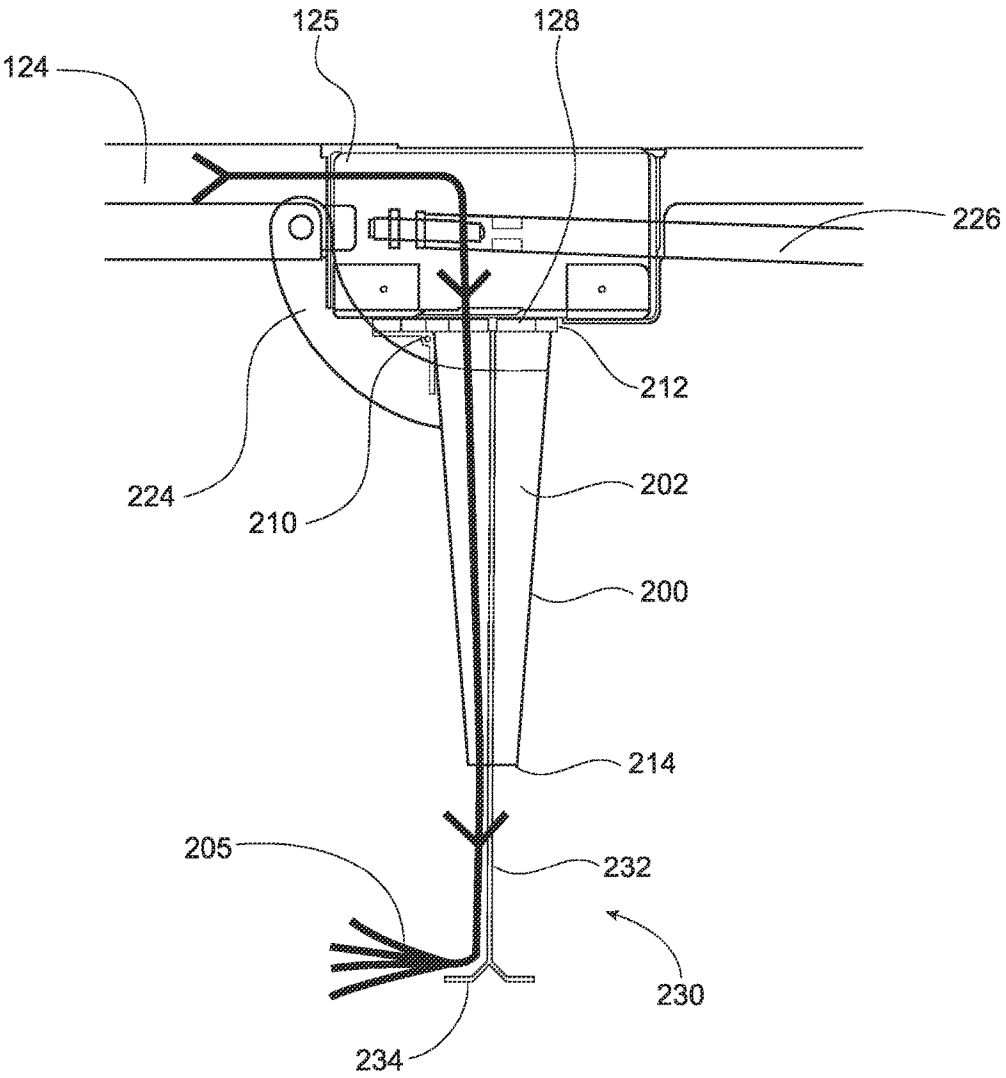
FIGS. 6 and 7 show a divider according to embodiments of this invention.
Figure 7:
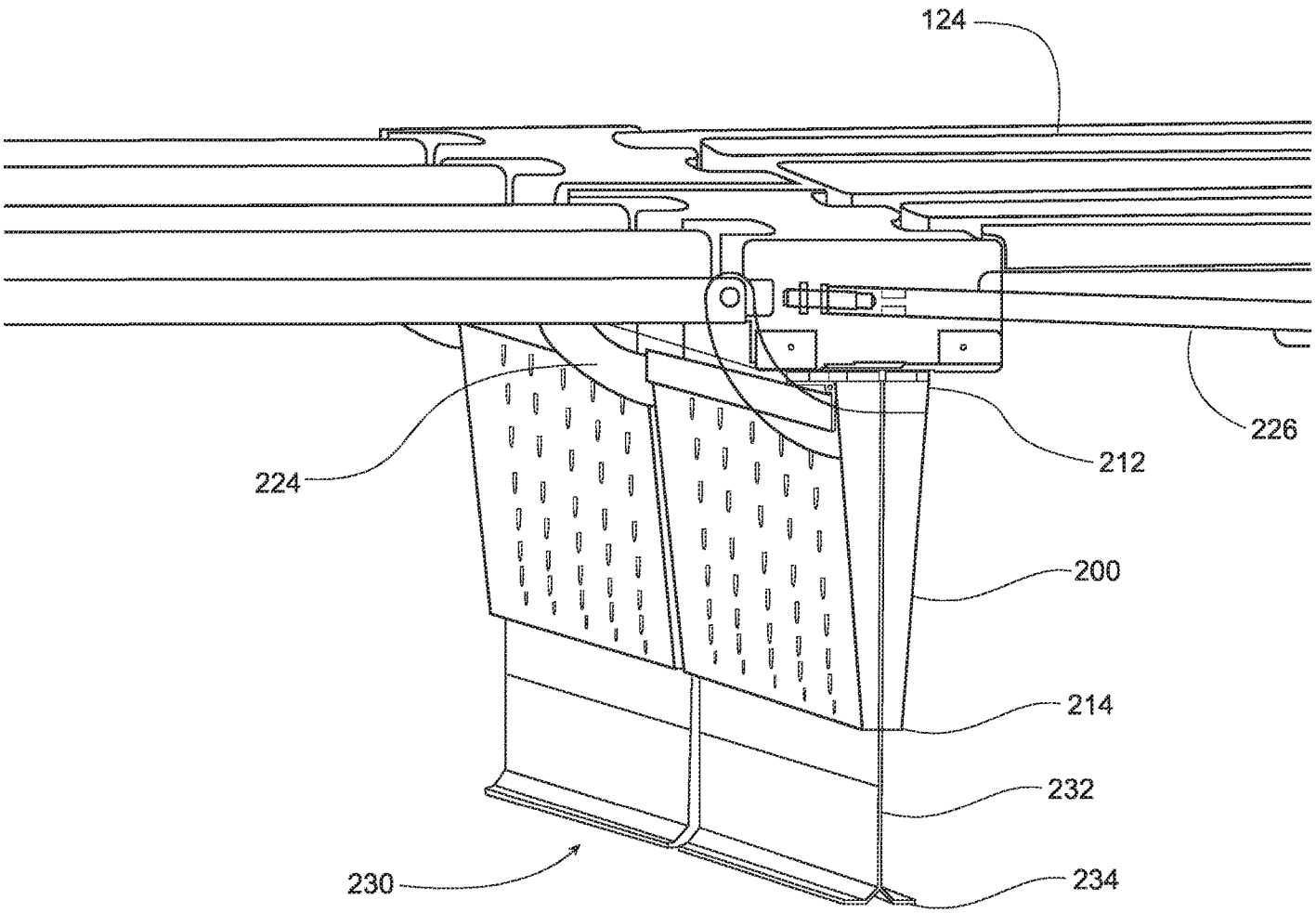
Figure 8:
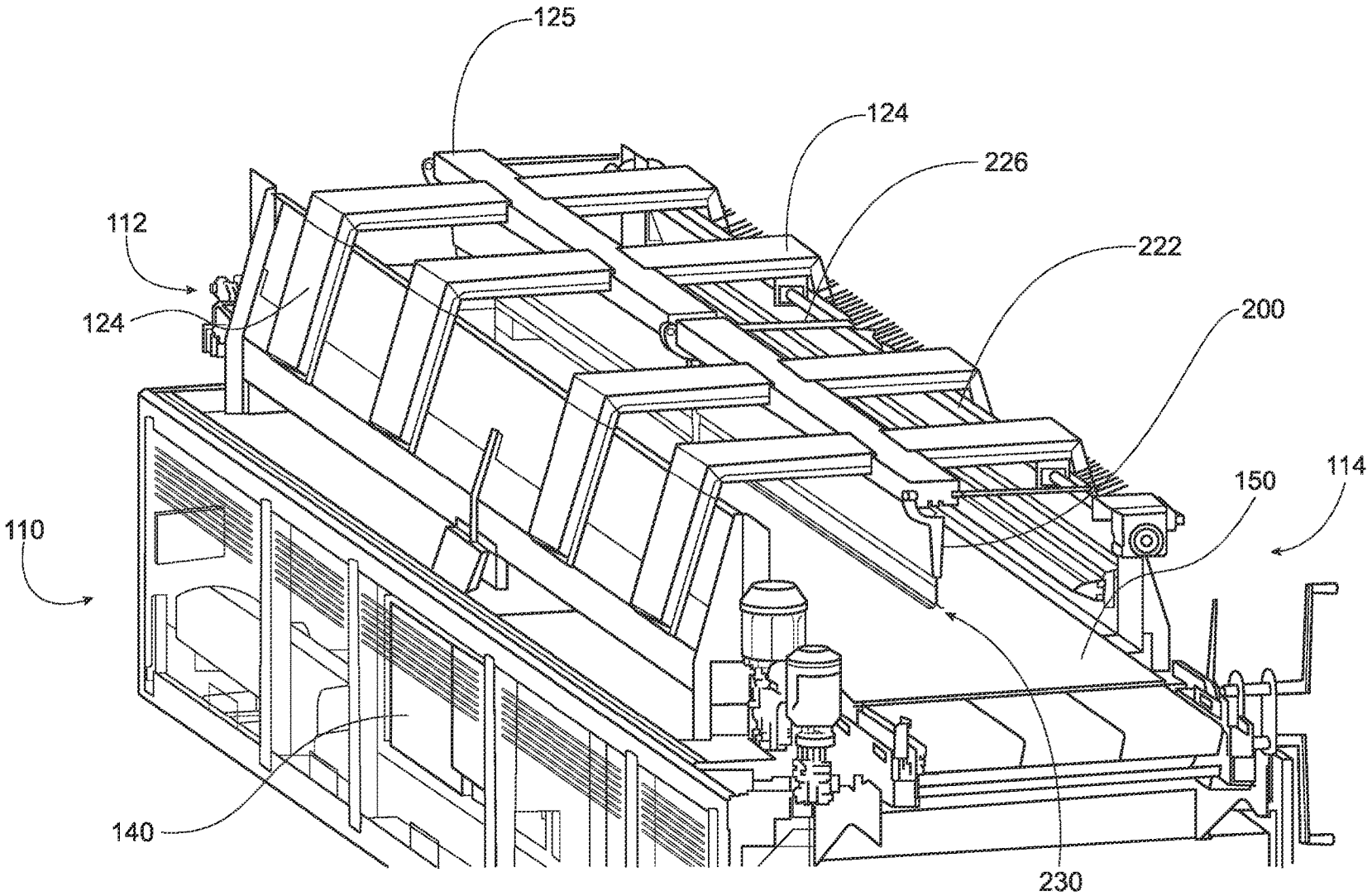
FIG. 8 shows a perspective section view of the apparatus of FIG. 5.

As shown in FIGS. 5 and 6, the center divider 200 includes an internal air passageway 202 extending from an air inlet at a first end 212 to an air outlet at an opposite second end 214. The first end 212 is abutting duct outlet 128, which is connected to the duct system 124, as shown in FIG. 8. The internal air passageway 202 of the center divider 200 reduces in diameter from the inlet to the outlet end. As shown in FIG. 7, the center divider 202 can be formed of several adjacent divider subsections, with a plurality of swing mechanisms, as needed, extending along the length of the oven and/or conveyance path 116.

The deflector mechanism 230 extends beyond and/or below the air outlet of the second end 214. The deflector mechanism includes a linear extension 232 that extends from the second end 214, and divides air outlet into two outlet sections, one on each side of the linear extension 232. The linear extension is shown in FIG. 6 as extending through the entire air passageway 202, but can vary in configuration, as well as length beyond the second end 214, depending on need.

As shown in FIGS. 5 and 6, the deflector mechanism 230 divides the air flow into two opposite, lateral jets of air, each directed across the conveyance path 116 toward the side assemblies 112 and 114, respectively. The illustrated deflector mechanism 230 includes a curved deflector 234 at an end of the linear extension 232. The deflector 234 includes curved surface extending in opposite directions, respectively, toward each of the first and second side wall assemblies 112 and 114. As shown in FIGS. 5 and 6, the curved deflector 234 divides the air from the outlet end into two lateral jets of air 205.

Figure 9:
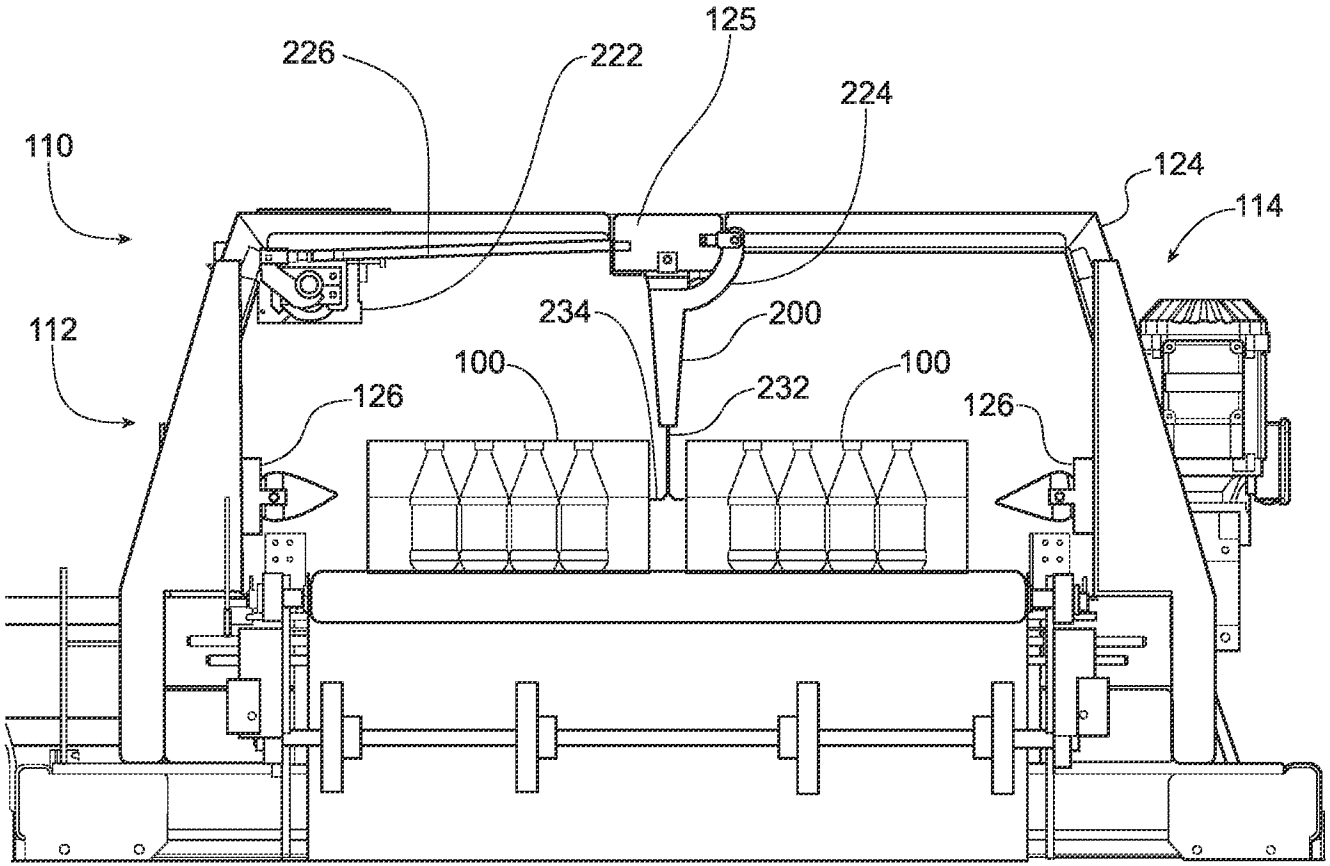
FIGS. 9 and 10 each show an operation of the apparatus of FIG. 5.
Figure 10:
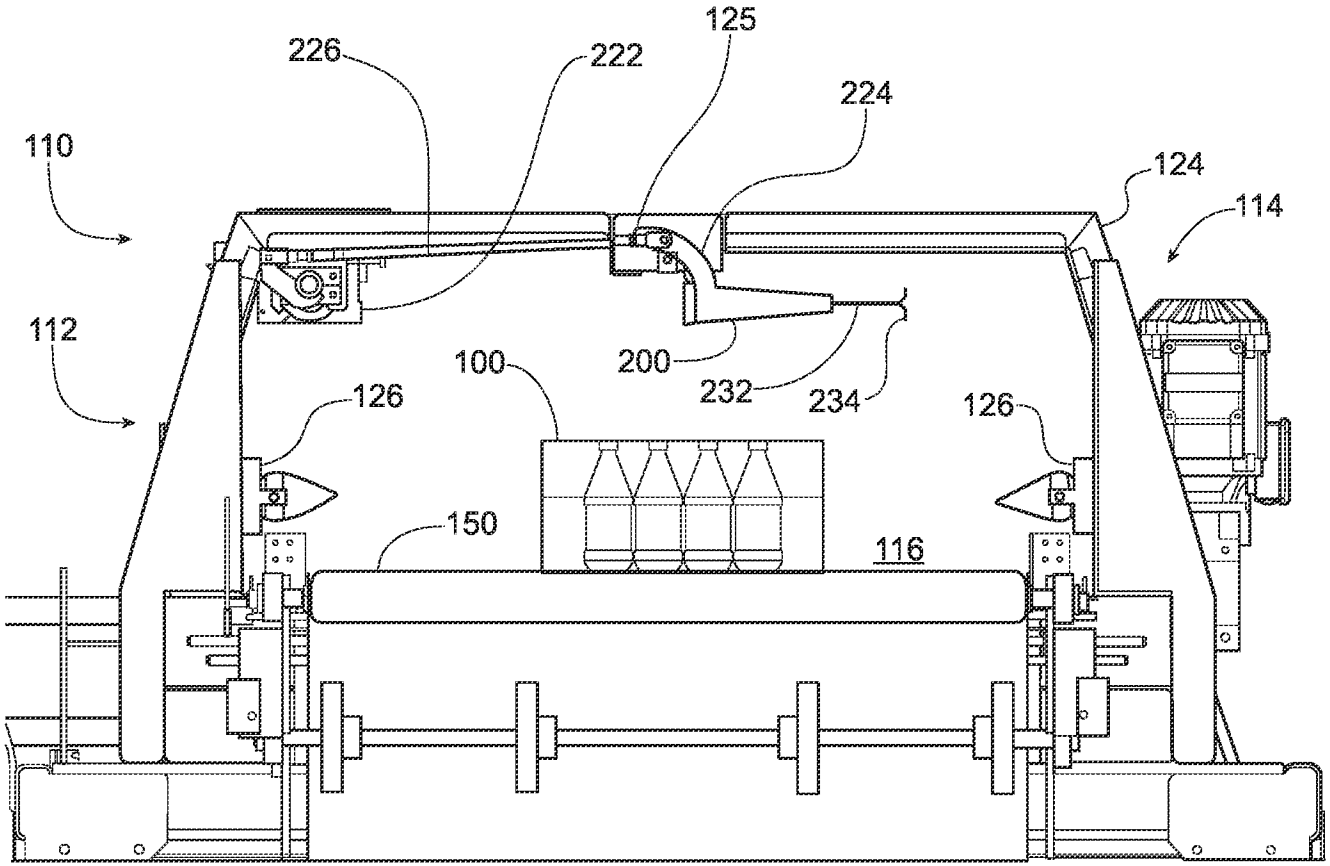

As shown in FIG. 9, the lateral jets of air can be directed to a side of the products opposite the air from the oven air discharge openings 126. The center lateral air jets of this invention, along with the funneled air of the cone-shaped divider, provide an improved smooth air flow that prevents the film from fluttering and/or inflating like a bubble, resulting in a tighter and/or a better-looking final package. FIG. 10 illustrates the center divider 200 swung into the retracted position to provide a single track conveyor, such as according to the method and components discuss above.

Thus the invention provide a flexible use, single/dual conveyance path with improved air flow. In additional the rigid duct structure reduces maintenance over current flexible hose systems.

It is to be further understood and appreciated that the numerous above-identified and/or described features of the subject product packaging apparatus and methods can be appropriately practiced alone or individually or in various combinations as may be desired for a particular or specific application.

Those skilled in the art and guided by the teachings herein provided will understand and appreciate that the broader practice of such aspect of the subject development is not necessarily limited to devices so constructed or operated as devices of alternative construction or operation can, if desired, be appropriately incorporated and utilized herewith.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. An apparatus for heat shrink wrap product packaging, the apparatus comprising:

first and second opposed and spaced apart side wall assemblies, the first and second side wall assemblies defining a longitudinally extending product conveyance path therebetween;

an air duct extending over the conveyance path;

a center divider extending from the air duct and above the conveyance path between the first and second opposed and spaced apart side wall assemblies, wherein the center divider is connected to the air duct by a rotation connection whereby the center divider moves between a retracted position and a vertical position dividing the conveyance path;

wherein the air duct includes an air outlet and the center divider includes an air inlet, and in the retracted position the air inlet is rotated away from and off of the air outlet, whereby in the retracted position air flow in the air duct exits through the air outlet over the conveyance path.

2. The apparatus of claim 1, wherein the air duct comprises a central duct extending longitudinally over the conveyance path, wherein the center divider is connected to the central duct by a hinge connection.

3. The apparatus of claim 1, wherein the vertical position forms and extends between two package tracks on the conveyance path.

4. The apparatus of claim 1, wherein the center divider comprises an internal air passageway and a lateral air flow mechanism configured to deliver air across the conveyance path in directions toward each of the first and second side wall assemblies.

5. The apparatus of claim 4, wherein the lateral air flow mechanism comprises a plurality of air openings in opposing side walls of the central divider or a deflector at an air outlet end of the central divider.

6. The apparatus of claim 1, further comprising an electric motor connected to the center divider by a mechanical linkage.

7. The apparatus of claim 6, further comprising an air duct extending over the conveyance path, wherein the center divider is connected to the air duct by a rotation connection, and the mechanical linkage comprises at least one arm extending from the center divider about the rotation connection.

8. The apparatus of claim 1, wherein the center divider extends over a duct opening in the vertical position and the duct opening is uncovered to discharge air downward over the conveyance path in the retracted position.

9. The apparatus of claim 1, wherein in the retracted position the center divider is rotated away from the conveyance path and in the vertical position the center divider is perpendicular to the conveyance path.

* * * * *